United States Patent [19]

Walters et al.

[11] Patent Number: 4,813,891

[45] Date of Patent: Mar. 21, 1989

[54] ELECTRICAL CONNECTOR FOR DIVERTING EMP

[75] Inventors: Gerald E. Walters, Granada Hills; Clinton H. Dutcher, Thousand Oaks; Tian-Peng Tang, Woodland Hills; Jerry Nurek, Los Angeles, all of Calif.

[73] Assignee: G & H Technology, Inc., Camarillo, Calif.

[21] Appl. No.: 76,271

[22] Filed: Jul. 22, 1987

[51] Int. Cl.[4] ..... H01R 13/66

[52] U.S. Cl. ..... 439/620; 361/119

[58] Field of Search ..... 439/607–610, 439/620; 361/118, 119, 126, 127

[56] References Cited

U.S. PATENT DOCUMENTS

| | | | |
|---|---|---|---|
| 2,906,925 | 9/1959 | Yonkers et al. | 317/61 |
| 2,965,779 | 12/1960 | Zalesak | 313/51 |
| 3,450,925 | 6/1969 | Johnson | 313/229 |
| 3,702,420 | 11/1972 | Cooper | 317/61 |
| 4,276,523 | 6/1981 | Boutros et al. | 439/620 |
| 4,365,282 | 12/1982 | Brainard | 361/119 |
| 4,572,600 | 2/1986 | Nieman | 339/14 R |
| 4,606,598 | 8/1986 | Drzymkowski et al. | 439/620 |
| 4,726,991 | 2/1988 | Hyatt et al. | 428/329 |

*Primary Examiner*—John McQuade

*Attorney, Agent, or Firm*—Kenneth J. Hovet

[57] ABSTRACT

An electrically conductive block assembly is provided for positioning contact pins in an electrical connector and dissipating high energy voltage pulses to a ground. A voltage variable material is used to space the pins out of direct contact with the block. The block is in electrical communication with a grounded electrical connector housing. High voltage pulses to the contact pins will divert into the voltage variable material, through the block and to the grounded housing.

9 Claims, 2 Drawing Sheets

ELECTRICAL CONNECTOR FOR DIVERTING EMP

BACKGROUND OF THE INVENTION

1. Field of the Invention

The present invention relates to electrical connectors and, more particularly, to an electrical connector having grounding means for transient high voltage pulses.

2. Description of the Prior Art

Transient voltage pulses of electromagnetic radiation (EMP) are known to result from lightning and nuclear explosions. Such pulses can detrimentally affect solid state circuitry in precision instruments, communication systems and computer components. To protect the sensitive circuitry, metal housings and compartments have been used to ground the EMP. However, most all housings and compartments are still vulnerable because they are penetrated by connectors that link electrical cable which serve as pathways for EMP.

To overcome the above vulnerability, connector devices have evolved which contain EMP diversion means. U.S. Pat. No. 3,702,402 discloses an electrical connector having connector pins coated with a dielectric material to a thickness of 0.005 to 0.030 inch. The dielectric material functions to stimulate arcing across the end of the material from the connector pin to a grounded shell.

The patented device requires an arc-over discharge chamber and the end of the dielectric material must be flush with an adjacent conductive surface. Otherwise, arcing at the desired voltage level will not occur. Venting ports are used with the discharge chamber and, in the case of a high-current lightning strike, the connector pins may explode and deposit molten metal about the chamber. This shorts the pins to the grounded shell and is described as providing fail-safe protection.

A semiconductor diode is used in U.S. Pat. No. 4,572,600 to divert EMP to a ground plane. Here, a notch in a connector pin is provided with a diode which is secured by a circumferential band. A surrounding spring holds the band and diode in place. In it also in electrical contact with a ground plane. EMP transients are thereby diverted from the pin by the diode, then to the band, spring and finally to the ground plane. An important function of the above multi-part assembly is to assure uninterrupted electric contact during exposure to shock and vibration.

SUMMARY OF THE INVENTION

The invention provides an electrical connector having a unique connector pin mounting block assembly. One or more openings in the mounting block are filled with a voltage variable material having a central aperture through which a contact pin extends. The block is electrically conductive and is in electrical contact with a grounded housing. The block is secured within the housing and is environmentally sealed at opposing ends.

The voltage variable material (VVM) functions as a voltage variable resistor between the pin and ground plane. In the normal voltage operating range, the pin-to-ground resistance will be high imparting transparency to the connector system. When an EMP transient occurs, VVM resistance will drop and the current will pass through the material to the mounting block and then to the grounded housing.

DESCRIPTION OF THE PREFERRED EMBODIMENTS

Figure 1:
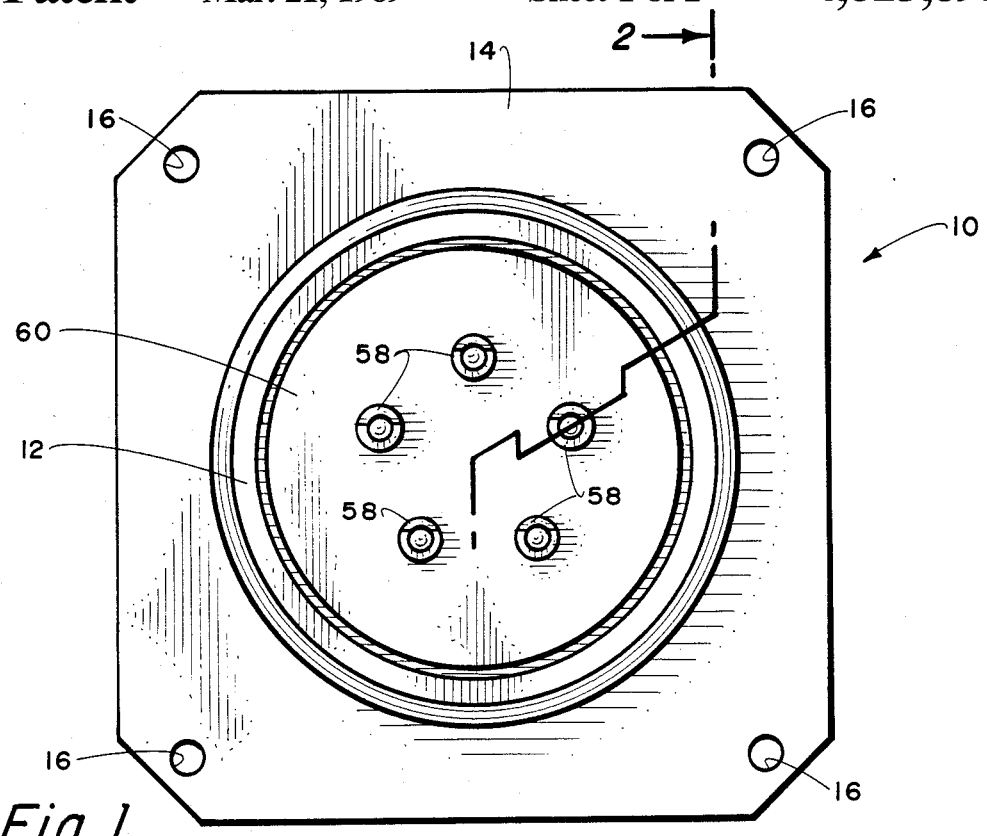
FIG. 1 is a rear end elevational view of an electrical connector constructed in accordance with the present invention.
Figure 2:
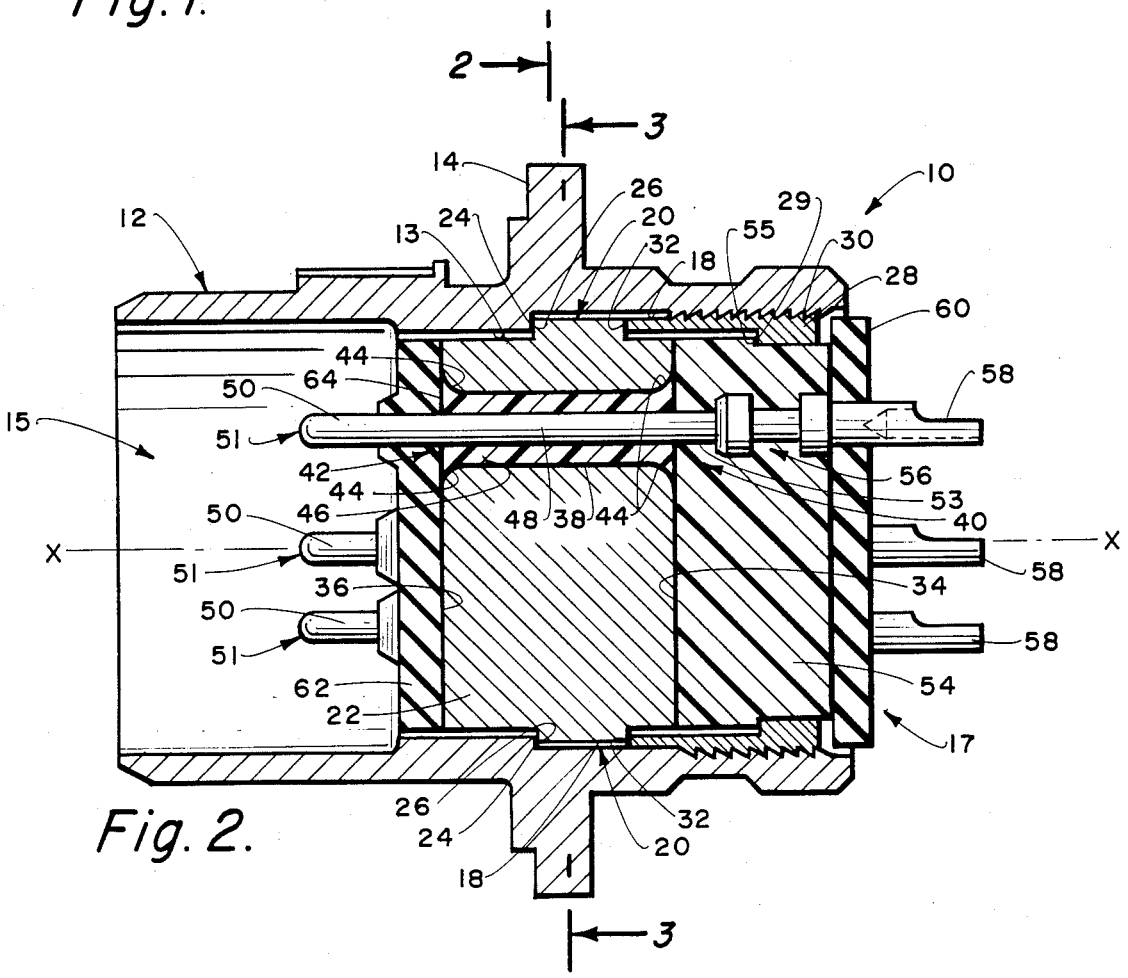
FIG. 2 is a cross-sectional view taken along lines 2—2 of FIG. 1.
Figure 3:
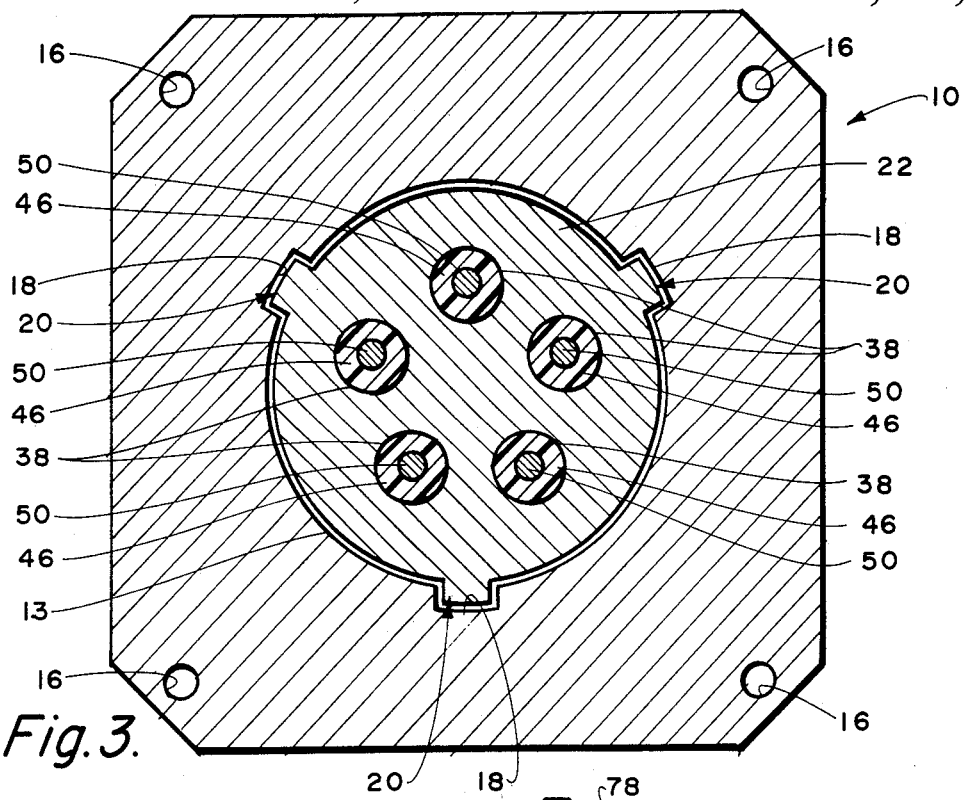
FIG. 3 is a cross-sectional view taken along lines 3—3 of FIG. 2.

With reference now to the drawings, FIGS. 1–3 illustrate a multi-pin electrical connector shown generally by reference 10. The connector includes an electrically conductive housing 12 which has an overall tubular shape with a front section 15 and a rear section 17. An external mounting means is shown as peripheral flange 14. The flange includes fastener openings 16 for attaching the connector to the wall of a grounded support structure, panel or casing.

The interior surface 13 of the housing is provided with keyways 18 for engagement with corresponding projections 20 on exterior portions of mounting block 22. Each of the keyways includes an abutment wall 24 which engages an end surface 26 of each projection 20. With this construction, the block will be constrained against axial and rotational movement when placed into the housing.

To insure against loosening of the blocks, retaining ring 28 is used to engage the opposing end surfaces 32 of projections 20. Inclined teeth 30 serve to engage the housing interior and hold the ring in place.

The mounting block is cylindrical in overall shape with an end comprising a first planar face 34 and an opposing end comprising second planar face 36. The faces are parallel to each other and perpendicular to the center axis x,x of the housing 12. The block circumference is in electrical contact with the housing interior surface 13.

Extending through the block parallel with the center axis are openings 38. Each opening forms a first entrance 40 on the first face and a second entrance 42 on the second face. The openings are preferably round in cross-section, but may have other shapes as determined by the shape of pins 50. The entrances are rounded and defined by curved edge 44.

Each of the openings are filled with VVM 46. A pin aperture 48, having a diameter substantially less than each opening and about equal to the diameter of pin 50, extends through the material concentric with the longitudinal axis of each opening. In this way the pin, when extending through the aperture, will always be spaced-apart from the mounting block by an effective thickness of VVM.

The pins are shown as elongated shafts having a circular cross-section. However, ellipsoidal or polygonal shapes could be used. Each pin includes a free end 51 and a proximal end 53. The free end extends into the open front section 15 of the housing for engagement with the corresponding socket of a matching connector receptacle (not shown). Proximal end 53 extends into base 54 for securement to a sleeve and collar assembly 56 in a manner to be hereinafter described.

As shown in FIGS. 1 and 3, five of the pins are oriented in a predetermined pattern about the amounting block crosssection. Any number of pins, other sizes or different patterns could be used, however, as required by the intended use of the overall connector.

Directly adjacent the first face 34 and first end 52 of the VVM is the aforementioned base 54. The base functions as a foundation for pins 50 and serves to eliminate any air space in the housing rear section 17. It is preferably formed of a thermosetting resin and corresponds in cross-section to the housing interior. It includes an outer peripheral shoulder 55. The shoulder engages a corresponding detent 29 of ring 28 for securement of the interior parts.

Embedded within the base is a sleeve and collar assembly 56. This assembly retains the proximal end 53 of pin 50. Each assembly includes a crimping extension 58 for direct attachment to an external electrical system (not shown).

Overlying the outer surface of base 54 is a grommet 60. The grommet is a flexible sealing member and serves to environmentally protect the base and the other interior parts. Similarly, seal member 62 is located directly adjacent the second face 36 and second end 64 of the VVM. It seals about the pins, eliminates any air gaps and also protects the interior parts of the connector.

Figure 4:
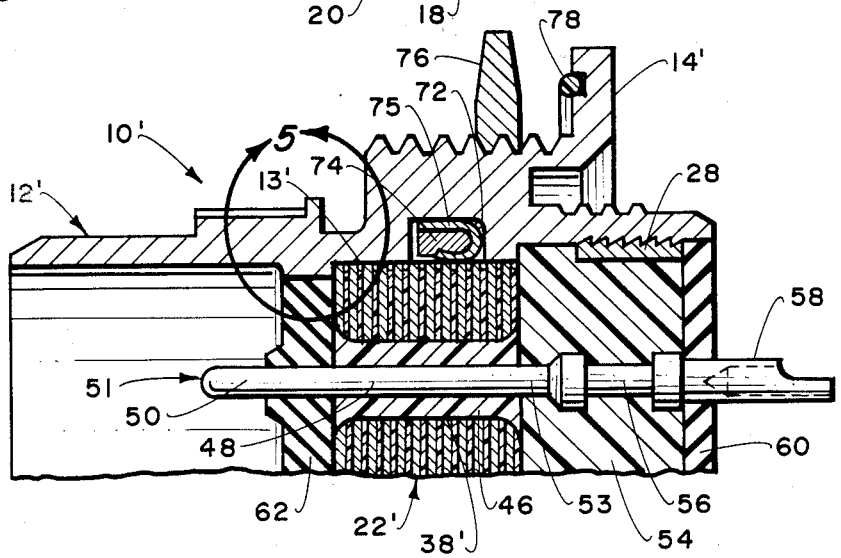
FIG. 4 is a fragmentary cross-sectional view similar to FIG. 2 showing an alternative mounting block and housing assembly.
Figure 5:
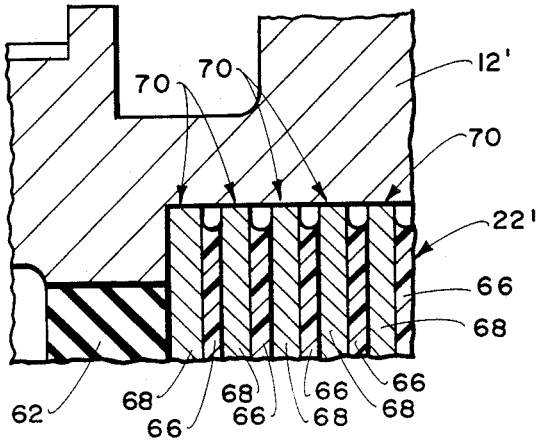
FIG. 5 is an enlarged fragmentary cross-sectional view taken along line 5 of FIG. 4.

FIGS. 4–5 show a modified connector 10′ with an alternative mounting block 22′. The alternative mounting block comprises alternating layers of thin plastic 66 bonded to alternating layers 68 to electrically conductive material. In particular, wafers of brass, copper or aluminum may be bonded together with layers of dielectric materials such as heat formable plastics, e.g., polyethylene, or curable plastics like epoxy resin.

Each of the layers comprise flat discs of uniform thickness which are perforated with openings 38′. The discs are oriented with their planar surfaces perpendicular to the center axis of the connector. Utilizing a laminated block as described above, serves to minimize the deleterious effect of electrical eddy currents that may occur in a solid metal block.

As described with the FIGS. 1–3 embodiment, the housing interior surfaces 13′ are preferably circular in cross-section as is the mounting block cross-section. A good fit with physical contact of the block circumference to the interior surfaces of the housing is important to insure current flow to the ground plane. Although not preferred, it will be understood that the housing, mounting block and other interior parts of both the FIGS. 1–3 and FIGS. 4–5 embodiments may have polygonal, ellipsoidal or other cross-sectional shapes or a combination thereof.

Several block-to-housing contact means may be used to enhance effective current flow. For example, the conductive layers may have a greater radial extent, shown by reference 70 in FIG. 5, than the plastic layers. In this way, the metal edges will have unobstructed engagement with the housing interior surface. Also, the circumference of the laminated block may include a thin electrically conductive coating. Again, this will facilitate electrical contact with the housing. Further, retainer ring 28 may be constructed of electrically conductive material. Since it bridges the block-to-housing joint as shown in FIG. 2, it will function as a conduit for current flow.

As an additional enhancement to current flow, FIG. 4 shows housing 12′ with an annular recess 72. The recess contains a contact ring 74 that includes metallic fingers 75 for engaging both the block and housing. In this manner, the fingers provide multiple pathways for current flow.

Housing 12′ is particularly suited for attachment to an opening in a wall panel or the like. It includes a threaded jam nut 76 which will secure the panel opening periphery against flange 14′. An O-ring 78 is used to seal the opening against environmental contaminants.

In FIGS. 4–5, the overall arrangement of interior parts is the same as that shown with the FIGS. 1–3 connector. Block openings 38′ are filled with the VVM 46. Apertures 48 are provided through the VVM for contact pins 50 and the pins, with respective sleeve and collar assemblies, are embedded in base 54. The VVM is sealed at the connector front section with seal member 62 and across the base outer surface with grommet 60. The interior assembly presents a solid void-free tightly engaged unit that has great shock and vibration resistance.

When an EMP occurs, current will flow from pin 50 through the conductive layers 70 and then through any of the abovedescribed pathways to the housing ground plane. The harmful voltage pulse will be dissipated and sensitive circuitry will remain intact.

While the invention has been described with respect to preferred embodiments, it will be apparent that various modifications can be made without departing from the scope of the invention. Accordingly, the invention should not be limited by the illustrative embodiments, but only by the scope of the appended claims.

We claim:

1. An electrical connector comprising:

a grounded electrically conductive casing;

an electrically conductive mounting block in electrical communication with said casing having opposing faces which are sealed and void of an open area, said block having at least one opening extending therethrough;

void-free voltage variable material filling said opening with a central aperture extending coextensively with said opening; and, an electrical contact pin extending through said aperture out of contact with said block, said voltage variable material forming an electrical path from said pin to said block for diverting transient high voltage pulses.

2. The connector of claim 1 including means for enhancing current flow between said block and said casing comprising a contact ring having metallic fingers in contact with said casing and said block.

3. The connector of claim 1 wherein said opening has a rounded entrance at each face which is filled with said variable voltage material.

4. The connector of claim 3 wherein said block comprises alternating layers of dielectric material and electrically conductive material oriented perpendicular to the center axis of said connector.

5. The connector of claim 1 wherein one of said opposing faces is covered with a non-conductive base.

6. The connector of claim 5 wherein said base is constructed of a thermosetting resin.

7. The connector of claim 4 wherein said layers of electrically conductive material have a greater radial extent than said layers of dielectric material.

8. The connector of claim 6 wherein said contact pin has a proximal end secured in said base and a free end extending through said aperture.

9. The connector of claim 8 including a sleeve and collar assembly embedded in said base with the proximal end of said pin retained within said assembly.

* * * * *